US005913491A

United States Patent [19]

Bulla

[11] Patent Number: 5,913,491

[45] Date of Patent: Jun. 22, 1999

[54] PAPER ROLL HOLDER

[76] Inventor: Vance Bulla, 6419 Charlotte Rd. Cr., Nashville, Tenn. 37209

[21] Appl. No.: 08/950,526

[22] Filed: Oct. 14, 1997

[51] Int. Cl.[6] ..... B65H 16/04; B65H 19/00

[52] U.S. Cl. ..... 242/597; 242/597.8

[58] Field of Search ..... 242/597, 597.7, 242/597.8

[56] References Cited

U.S. PATENT DOCUMENTS

| | | | |
|---|---|---|---|
| 3,750,971 | 8/1973 | Chevas | 242/597.8 |
| 4,416,425 | 11/1983 | Kish | 242/598.1 |
| 5,765,775 | 6/1998 | Keserica | 242/597 |

FOREIGN PATENT DOCUMENTS

| | | | |
|---|---|---|---|
| 283 003 | 9/1952 | Switzerland | 242/597.7 |

*Primary Examiner*—John Q. Nguyen

*Attorney, Agent, or Firm*—Paul H. Gallagher

[57] ABSTRACT

A back plate and a pair of transversely spaced vertical side plates extending forwardly therefrom. A first of the side plates is rigid with the back plate, and the second side plate is pivotal on a forwardly extending horizontal axis. A spindle is secured at one end to the forward end of the second side plate, with a free end extended therefrom. The second side plate is movable between a closed position in which the spindle extends into close proximity to the first side plate, and an open position in which the extended end is directed upwardly, free of the first side plate for enabling placement of a paper roll on the spindle.

8 Claims, 2 Drawing Sheets

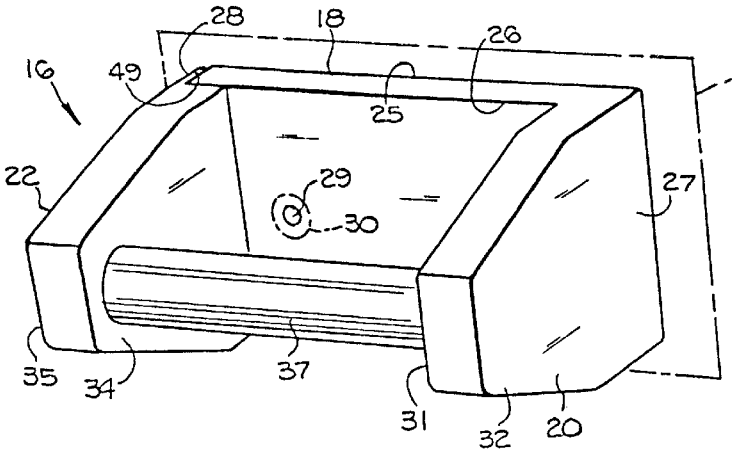
Fig. 1
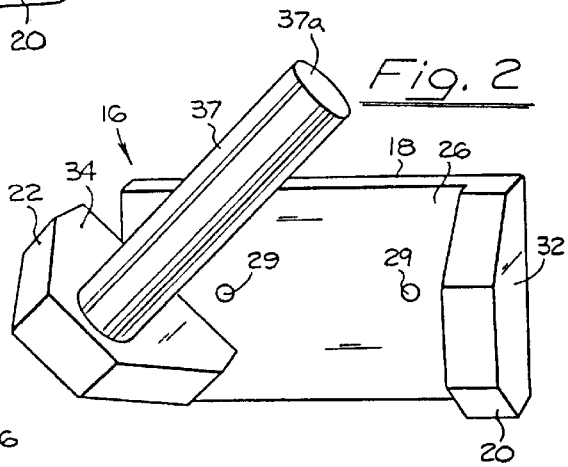
Fig. 2
Fig. 3
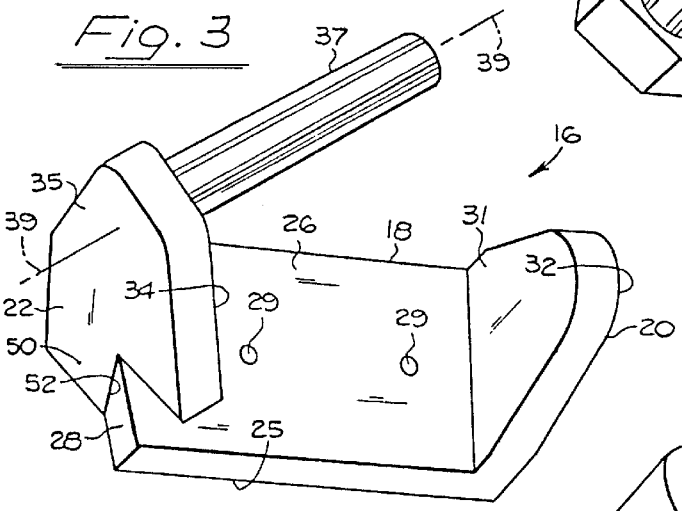
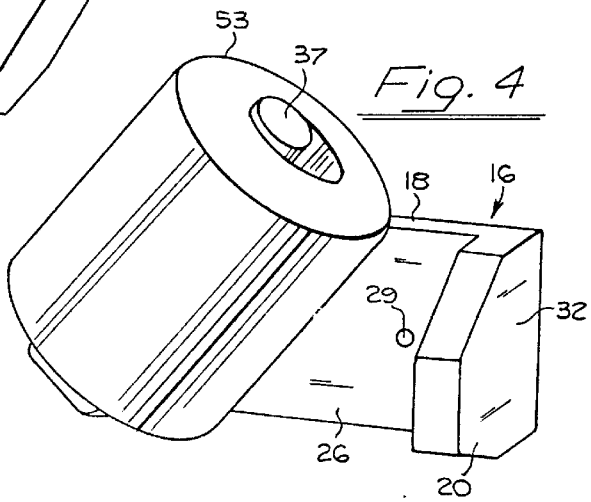
Fig. 4

PAPER ROLL HOLDER

SUMMARY OF THE INVENTION

The invention resides in a holder for rolls of paper, in the use of which a full roll of paper is loaded in it, and after its use, replaced by a new roll.

The holder is constituted by an extremely simple article. It is inexpensive to manufacture, both in materials used, and in the steps of fabricating it, since there are only two main parts. There are no added constantly moving supplementary elements, such as springs and hinges.

A very important feature of the invention is that the device can be manipulated in its use by one hand.

Another feature is that its use involves only simple steps: a new paper roll can be applied to, or loaded in, the holder with great ease and simplicity, and similarly, residual elements and remains of an old roll, can be removed easily.

BRIEF DESCRIPTIONS OF THE INDIVIDUAL FIGURES OF THE DRAWINGS

FIG. 1 is a perspective view of the holder of the invention, from the front, in closed position.

FIG. 2 is perspective view from the front showing the holder in open position, taken at an angle slightly different from that of FIG. 1, taken from right and above.

FIG. 3 is a perspective view of the holder in open position, taken at an angle from the left and below.

FIG. 4 is a view oriented according to FIG. 2 but with a paper roll mounted thereon.

DETAIL DESCRIPTION OF THE DRAWINGS

Figure 10:
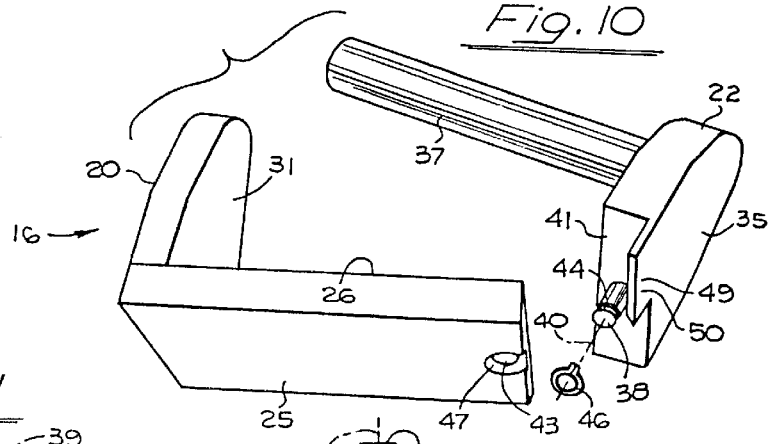
FIG. 10 is a perspective view from the corner opposite that of FIG. 9.

The holder of the invention, in its entirety, is indicated at 16, and includes a back plate 18 and side plates 20, 22 respectively. The holder is mounted in position by fitting the back plate to a wall 24, the back plate having a planar back surface 25 (FIG. 10), a front surface 26, a right end edge surface 27, and a left end edge surface 28. The back plate is provided with holes 29 for receiving screws 30 for mounting the device on the wall. When the holder is so mounted, it is oriented according to its intended use, and may be referred to as in a vertical mounting. The holder in the following description is considered oriented according to such mounting, unless otherwise specified, and will be viewed, as to right, left, according to the holder being observed from the front, the side plate 20 being the right side plate, and the side plate 22 being the left side plate. These two side plates will also be referred to, particularly in the claims, as being the first and second side plates respectively. The back plate and the side plates are of substantial vertical dimensions, for solidity.

The side plates 20, 22 are mounted on, or secured to, the back plate 18 and extend forwardly therefrom. The first or right side plate 20 is rigidly fixed to, and preferably integral with the back plate, at the right hand end of the latter, and the side plate 22 is swingably mounted at the opposite end of the back plate. The side plate 22 has a closed position (FIG. 1) and an open position (FIG. 2) as described fully hereinbelow. In its closed position it is vertical, and parallel with the side plate 20, but in open position it is at an angle relative thereto. The side plates are similar in shape, and congruent when the holder is in closed position, as viewed from either side. Also when the holder is in closed position, the side plates are perpendicular to the back plate.

For convenience in identification, the side plate 20 has an inner surface 31 and an outer surface 32, while the other side plate 22 has an inner surface 34 and an outer surface 35.

Figure 12:
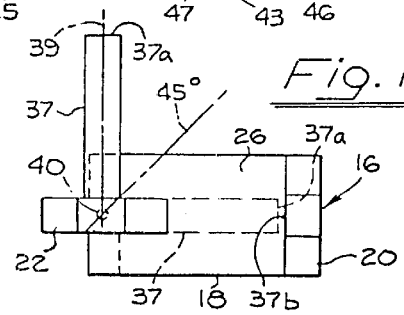
FIG. 12 is a view similar to FIG. 11 but with the spindle at a different angle.

A spindle 37 is rigidly mounted on, secured to, or incorporated with the side plate 22, being secured at an inner end to the forward or extended end of the side plate 22. The spindle is perpendicular to the side plate, and when the holder is in closed position, the spindle extends transversely across the holder, and has a free end 37*a* in close proximity to the inner surface of the other side plate 20. The spindle, at its free end, or extended end does not engage the side plate 20, but is preferably spaced therefrom at a small distance, such as 1/16", as shown at 37*b* (FIG. 12). However, if it should be desired that the spindle engage the side plate 20, the scope of the invention is sufficiently broad to cover that arrangement. As used herein, and particularly in the claims, adjacent to generically covers engaging.

Figure 9:
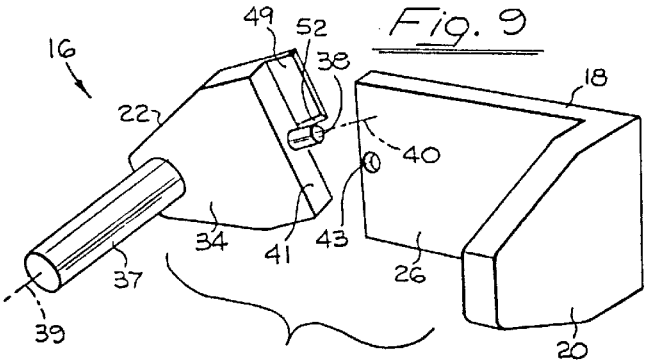
FIG. 9 is a perspective view oriented similarly to FIG. 1, showing the main parts of the holder separated.

The side plate 22 is mounted on the back plate 26 for pivotal swinging movement by means of a horizontal pintle 38 (FIGS. 9, 10) having a longitudinal axis 40, and extending rearwardly from the rear edge surface 41 of the side plate, and fitted in a hole 43 in the back plate. The pintle is provided with a circumferential groove 44, which is exposed at the rear end of the hole, and a snap ring 46 is releasably fitted in the groove for securing the pintle in the hole. The hole is counter sunk at 47 to receive the snap ring, forwardly of the outer back planar surface 25 of the back plate.

The left side plate 22 is provided with a cleat 49 extending rearwardly from the main portion of the side plate. The cleat has an outer surface 50 lying in the plane of the main outer surface 35 of the side plate, and is positioned generally above the pintle 38. The side plate 22 with the cleat is so shaped and dimensioned, that the greater part of the rear edge surface 41 (FIGS. 9, 10) of the plate engages the front surface of the back plate and the cleat 49 extends rearwardly thereof so that when the side plate is moved to closed position (FIG. 1) the cleat 49 engages the end edge 28 of the back plate, at the top of the latter.

The positioning of the pintle 38, the hole 43, and the cleat 49 is predetermined to enable the side plate to be swung up into a certain, desired open position. Preferably, and in the specific construction herein disclosed, the pintle axis 40 (FIGS. 9, 11) lies in a common plane with the central axis 39 of the spindle 37, the latter being perpendicular to the side plate 22. The side plate 22 thereby swings about the axis 40 of the pintle between closed and open positions.

Figure 6:
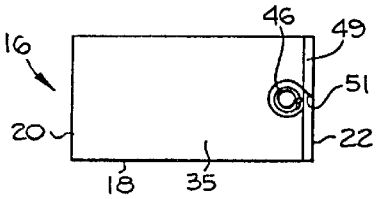
FIG. 6 is a small scale view from the rear.
Figure 7:
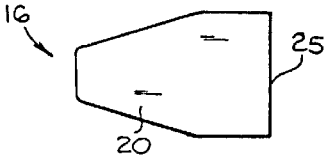
FIG. 7 is a small scale view from the right of FIG. 1.

In a preferred construction, the lower edge surface 51 (FIG. 6, 10) of the cleat 49 is inclined downwardly and outwardly, the lower edge of which lies in the plane 35 identified above, and about at the same height as the pintle axis 40 when the side plate is in closed position. When the side plate is swung to open position (FIGS. 3, 11) the inclined edge surface 52 engages the lower portion of the end edge of the back plate, establishing and limiting the side plate to a specific open position referred to below. However, if it should be desired to have it open to a greater extent, so that the spindle extends more nearly vertical, that is within the scope of the invention. This latter position is shown in FIG. 12, where the cleat is shown of lesser vertical dimension, i.e., the lowest edge of the bottom surface is above the pintle axis 40.

Figure 8:
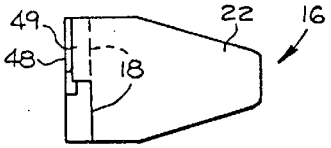
FIG. 8 is a small scale view from the left of FIG. 1.

The cleat may terminate rearwardly a short distance from the rear surface of the back plate, as at 48 in FIG. 8, so as not to rub or scrape on the wall in the swinging movements of the side plate between closed and open positions.

In the preferred construction of the device of the invention, and as disclosed herein, the back plate 18 and right side plate 20, are molded as a single piece, constituting a main component of the holder. Similarly the left side plate 22, the spindle 37 and the pintle 38 are of one piece, constituting another main component of the holder. Correspondingly the holder is made up essentially entirely of the two main components referred to, the screws 30 being utilized for holding the holder on the wall. Alternatively, an equivalent of the snap ring 46 could be made integral with one of the main components. The holder, thus being made up essentially of the two main components, is preferably made of molded plastic, and thus each is of one-piece integral construction.

Figure 5:
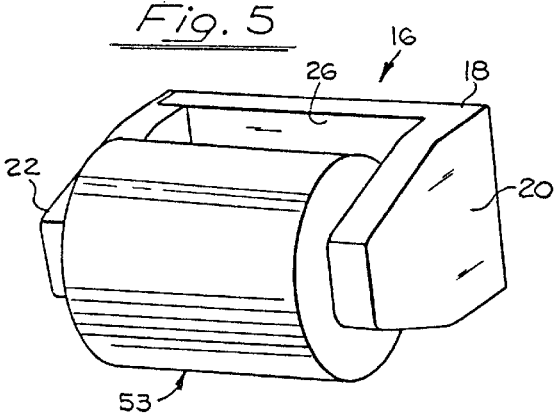
FIG. 5 is a view oriented according to FIG. 4 but with the holder in closed position.

In the use of the holder, assuming a closed position as in FIG. 1, the holder is manually moved to open position, i.e. the side plate 22 with the spindle, is swung counterclockwise about the axis 39 of the spindle. It is so moved until the cleat 53 (FIG. 3) engages the end edge of the back plate, and this cleat therefore positively limits the holder to a predetermined open position, as stated. Then the paper roll 53 is fitted on the spindle (FIG. 4), and the left hand side plate with the spindle, and with the paper roll so fitted thereon, is swung down into closed position (FIG. 5), with the holder in position for manual use, i.e. linearly pulling the paper off the roll. These movements can all be done with one hand, rendering the device extremely easy to use.

Figure 11:
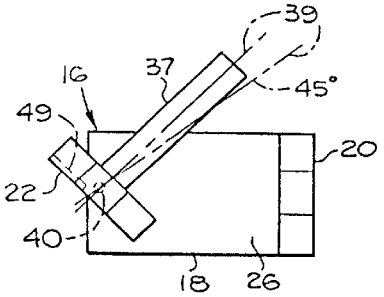
FIG. 11 is a face view from the front, with the holder in open position, indicating different positions of the side plate holding the spindle.

The dimensioning, proportioning, and positioning of the various elements referred to above, are preferably such that, in the open position, the spindle is a short distance beyond 45°, as indicated in FIG. 11, the 45° position being shown for convenience. This distance beyond 45° may be in the neighborhood of 5°, etc. The various elements are furthermore dimensioned for maintaining the end plate and spindle in a stable position, gravity held. When the roll is put on the spindle in the open position, it still remains stable, and then when the user moves the roll below the 45° angle, it moves by gravity into closed position. As used herein biasing covers action by gravity.

When the holder is moved to closed position, the cleat 49 (FIG. 6) engages flatly against the end surface of the back plate 18, at the top, as noted above, and this positively limits the movement of the holder to closed position. Also as noted above, this holding effect by the cleat, is relied on to the hold the spindle in place in the closed position, and there is no reliance on engagement by the spindle with the right hand side plate 20 for that purpose (FIG. 12).

Therefore the inner surface 31 of the side plate 20 may be of planar shape throughout and in the preferred form there are no projections thereon for limiting the movement of the spindle or guiding it.

I claim:

1. A holder for paper rolls comprising, a back plate adapted for mounting on a wall, a pair of transversely spaced side plates mounted on and extending forwardly from the back plate, a first of the side plates being fixedly and rigidly secured to the back plate, the second of the side plates being pivotally mounted on the back plate on a forwardly extending axis, the second plate being swingable about said axis between a closed position and an open position, a spindle secured at an inner side of the forward end of the second plate and having an extended end, wherein, mounted on the second side plate is a cleat that is structured to engage an end surface of the back plate and thereby limit the movement of the second side plate to both open and closed positions, wherein, in the closed position of the second side plate, the spindle extends between the side plates with the extended end closely adjacent the first side plate.

2. A holder according to claim 1 wherein, in the closed position, the side plates are structured to be in mutually parallel vertical position, and the spindle is perpendicular to the side plates, with the extended end of the spindle spaced from the first side plate, the second side plate is biased to closed position, and the second side plate and back plate have interengaging elements positively limiting movement of the second side plate into closed position.

3. A holder according to claim 2 wherein, the first side plate has an inner surface that is planar in shape at least through the (transverse extension) vertical dimension of the spindle where the spindle is adjacent that side plate.

4. A holder according to claim 3 wherein, the entire inner surface of the first plate is planar in shape.

5. A holder according to claim 2 wherein, secured to the second side plate is a pivotal pintle which, with the spindle, lies in a common plane perpendicular to the second side plate, the pintle pivotally and releasably fits in a hole in the back plate and constitutes the sole means mounting the second side plate on the back plate, said cleat is eccentric to the pivotal axis of the pintle, and in response to movement of the second side plate between open and closed positions, the cleat engages the back plate and thereby limits movement of the second side plate to both open and closed positions.

6. A holder according to claim 1 wherein, the back plate and the first side plate together constitute a main component that is unitary and of one piece, and the second side plate and the spindle constitute a main component that is unitary and of one piece.

7. A holder according to claim 6 wherein, said main components constitute substantially the entire holder.

8. A holder for paper rolls comprising, a back plate adapted for securement to a wall, serving as a support, the back plate having a back surface engaging the wall, and a front surface, the securement to the wall establishing a vertical orientation, a first side plate vertically oriented and extending forwardly from the back plate at one lateral end of the latter, and perpendicularly therefrom, the back plate and the first side plate together being constituted by a single molded, integral, piece, and constituting a first main component of the holder, a second side plate extending forwardly from back plate at the second lateral end of the latter, a spindle secured at an inner end of the spindle to the forward end of the second plate and extending perpendicularly to that plate, and having an extended end, a pivotal pintle extending rearwardly from the second plate and positioned in a hole in the back plate for mounting the second side plate on the back plate, the pintle and spindle lying in a common plane perpendicular to the second side plate, the second side plate having a rearwardly extending cleat engaging the lateral end edge of the back plate, the side plates having interfacing inner surfaces, and having opposite outer surfaces, the inner and outer surfaces of the first side plate being planar in shape throughout, the inner and outer surfaces of the second side plate being planar in shape throughout except for the spindle, the second side plate being swingable about the pintle between closed and open positions, and in the closed position being parallel with the first side plate, and the spindle being perpendicular to the side plates and having the extended end of the spindle closely adjacent the first side plate, in the open position, the spindle being positioned with the extended end exposed upwardly enabling a roll of paper to be placed on the spindle, and said cleat being positioned for interengagement between the cleat and the back plate for positively limiting movement of the second side plate into each the closed and open position.

* * * * *